US005702013A

United States Patent [19]

Freed

[11] Patent Number: 5,702,013

[45] Date of Patent: Dec. 30, 1997

[54] VIRTUAL HINGE

[76] Inventor: Anna B. Freed, 185 E. 85th St., New York, N.Y. 10028

[21] Appl. No.: 417,935

[22] Filed: Apr. 6, 1995

Related U.S. Application Data

[63] Continuation-in-part of Ser. No. 324,892, Oct. 18, 1994, Pat. No. 5,520,296, which is a continuation-in-part of Ser. No. 16,148, Dec. 9, 1993, abandoned, which is a continuation-in-part of Ser. No. 850,029, Mar. 12, 1992, Pat. No. 5,297,687.

[51] Int. Cl.[6] ..... B65D 55/02

[52] U.S. Cl. ..... 215/206; 215/213; 215/222; 215/223; 215/238; 116/308; 116/324

[58] Field of Search ..... 215/206, 211, 215/213, 216, 217, 218, 219, 220, 222, 223, 230, 235, 236, 237, 238, 240, 245, 318; 206/534; 116/308, 321, 323, 324

[56] References Cited

U.S. PATENT DOCUMENTS

| | | | |
|---|---|---|---|
| 3,587,896 | 6/1971 | Graff . | |
| 3,627,160 | 12/1971 | Horvath . | |
| 3,656,645 | 4/1972 | Fontenelli . | |
| 3,765,578 | 10/1973 | Stull . | |
| 3,766,882 | 10/1973 | Babbitt, III . | |
| 3,871,662 | 3/1975 | Hepp . | |
| 3,896,958 | 7/1975 | Robbins et al. . | |
| 3,904,063 | 9/1975 | Hauser | 215/318 |
| 3,996,879 | 12/1976 | Walter . | |
| 4,043,475 | 8/1977 | Wheeler . | |
| 4,053,077 | 10/1977 | De Felice . | |
| 4,053,078 | 10/1977 | Herr . | |
| 4,121,727 | 10/1978 | Robbins et al. . | |
| 4,238,033 | 12/1980 | Artzt . | |
| 4,365,721 | 12/1982 | Montgomery . | |
| 4,375,859 | 3/1983 | Fillmore . | |
| 4,397,397 | 8/1983 | Herr . | |
| 4,405,045 | 9/1983 | Villa-Real . | |
| 4,424,910 | 1/1984 | Heinol . | |
| 4,429,800 | 2/1984 | Greenspan . | |
| 4,485,932 | 12/1984 | Kusz . | |
| 4,573,598 | 3/1986 | Perry . | |
| 4,573,599 | 3/1986 | Fillmore . | |
| 4,579,238 | 4/1986 | Herr . | |
| 4,666,051 | 5/1987 | Trick . | |
| 4,739,890 | 4/1988 | Cooke . | |
| 4,749,093 | 6/1988 | Trick . | |
| 4,753,189 | 6/1988 | Mastman et al. . | |
| 4,913,083 | 4/1990 | Valvo et al. . | |
| 5,011,032 | 4/1991 | Rollman . | |
| 5,040,691 | 8/1991 | Hayes et al. . | |
| 5,065,876 | 11/1991 | Joyce . | |
| 5,082,129 | 1/1992 | Kramer . | |
| 5,083,671 | 1/1992 | Hayes . | |
| 5,292,017 | 3/1994 | Reifers . | |
| 5,312,010 | 5/1994 | Johnson . | |

FOREIGN PATENT DOCUMENTS

| | | |
|---|---|---|
| 7437858 | 1/1992 | France . |

*Primary Examiner*—Stephen Cronin
*Attorney, Agent, or Firm*—Darby & Darby

[57] ABSTRACT

A dynamic virtual hinge closure used for controlled, reliable, and measured dispensing of a variety of substances with extensive monitoring, child-resistance and senior-friendly features. A hook dynamically engages with a slot to create a virtual hinge each time the closure is opened. The hook dynamically disengages with the slot each time the closure is closed. Monitoring is accomplished by markers position on the outer surface of the container or lid. The closure may be opened in several ways, according to the users preference or ability. The monitoring may be for dispensing of food such as spices (i.e, pour, shake, spoon), for dispensing of drugs (1st, 2nd, 3rd dose). The internal structure insures that the lid shifts into a locked, child-resistant position when closed and also that the lid is opened exactly once at each marker position. The lid is made of only one piece and requires no assembly. The closure is easily moldable, sealed on the top and side, and configured to accept a moisture/vapor seal and/or tamper-evident film.

34 Claims, 4 Drawing Sheets

PM
AM 212
214
220
224
226
228
230
232
234
238
240
250
252
254
256
218
210
A
B
C
D 330
332
320
234
322
324
318
334
326
338
340
312
314
356
350
352
354
360
362

VIRTUAL HINGE

This application is a Continuation-In-Part of application Ser. No. 08/324,892 filed Oct. 18, 1994 now U.S. Pat. No. 5,520,296, which is a Continuation-In-Part of application Ser. No. 29/016,148 filed Dec. 9, 1993 now abandoned, which is a Continuation-In-Part of application Ser. No. 07/850,029, filed on Mar. 12, 1992, now U.S. Pat. No. 5,297,687 granted Mar. 29, 1994, the disclosure of which is hereby incorporated by reference.

BACKGROUND OF THE INVENTION

Field of the Invention

The present invention relates to container closures, in particular, to a dynamically created VIRTUAL HINGE™ closure which provides enhanced utility for dispensers and containers.

The present invention may be utilized as a closure for pharmaceutical products, food, spices, cleaning products, toxic substances, drags, lens covers, gas caps, film canisters and containers for candies, nuts, bolts, screws and notions, etc.

This closure may attach directly to a container or may be used as an overcap for an existing dispenser. The dynamic virtual hinge closure provides a synergistic effect when used as an overcap with dispensers such as pull-push, pumps, tilt-top, roll-on, sponge-tip, snap-type, sprays etc. Accordingly, virtual hinge closures have extremely widespread utility.

One important use is for both prescription and over-the-counter products. Although a child-resistant compliance closure is especially required by both the younger and older population segments, everyone would benefit from an improved closure which additionally is captive, senior-friendly, tamper-evident, easy to use, simple to understand, durable, reliable and inexpensive.

SUMMARY OF THE INVENTION

The present invention is very versatile. The container neck may be integral with a vial, or alternatively, it may be adapted to be screwed onto, or be force fit onto, the top of existing containers or dispensers. This enables pre-configured over-the-counter dispensers and prescription containers to be converted to child-resistant, senior-friendly, compliance closures.

The closure may be configured with or without monitoring features. Monitored dispensing may be on an "as desired" basis as with spices (i.e., shake, spoon, pour, etc.) or sequential (i.e., 1,2,3 . . . , etc.) as with prescription medications. The virtual hinge when attached to nasal sprays, eye drops, creams, powders, or pills, etc. helps the user monitor his/her medication regimen.

The closures of the present invention contain a bead on the lid which is held down by a hook on the container (or visa-versa). The lid is locked to the container on two diametrically opposite sides. On one side, by a hook hugging a bead, and on the other side by a locking lug held in a locking groove. The rim of the container having contact with the lid is flat, enabling insertion of a moisture/vapor seal and/or tamper-evident film. Additionally, the container and lid have contact on two contiguous surfaces (top rim and side).

Two basic embodiments, which are reversals of each other, are disclosed. In FIGS. 6–8C, the pointer, hook, and locking lug are on the lid; and the bead, markers and locking groove are on the container. In FIGS. 1–5B, 9–11C however, the pointer, hook, and locking lug are on the container; and the bead, markers, and locking groove are in the lid.

These embodiments have the same basic features:

- a one piece captive lid;
- may or may not be configured for monitoring;
- container and lid can be easily and inexpensively molded;
- lid need not be oriented to be assembled;
- ability to include a moisture/vapor seal or tamper-evident film;
- lid and container have contact on two contiguous surfaces;
- automatic locking feature causing the lid to dynamically shift into a locked position as it is closed;
- built-in logic—the lid opens once and only once as it passes each marker position;
- child-resistant and senior-friendly; and
- uses the familiar motions of "align and push up with thumb" for opening. Of course, the lid may not require child-resistance or monitoring features, i.e., as with gas caps, camera lenses, or food closures. The lid could simply alternate back and forth between a locked and unlocked position as shown in FIGS. 14–15.

An object of the present invention is to provide a useful and versatile lid which is reliable (no moving pans), inexpensive (only one part) and easy to manufacture (injection mold and/or injection blow mold) remains captive when opened, and is easy to assemble. The present invention has only one required pan besides the container neck, "the lid". The present invention requires fewer pans than any other known closure with these extensive features.

A further object of the present invention is to provide a simple closure that is independent of the dispenser. This virtual hinge lid may transform a dispenser to a closure with monitoring and/or child-resistance features.

A further object of the present invention is to facilitate use by the elderly, i.e., "senior friendly":

1) requires cognitive skills rather than strength to open;
2) has several opening alternatives—including leverage;
3) rotates in one direction only (whether being opened or closed);
4) is captive so that it will not be misplaced or lost;
5) may be used by visually impaired or blind users; and
6) has built-in logic for reliable operation;
   a) automatically shifts into a locked position when closed;
   b) must be opened prior to advancing; and
      c) will only open once at each marker prior to advancing.

A further object of this invention is that the closure be tamper-evident, i.e.;

1) A disk shaped film may be placed on the container rim inside the closure (which would have to be broken to access the contents).
2) A film may be placed around the interior and/or exterior of the slots (which are pierced by the hook when the user opens the lid).
3) A film may be placed around the exterior of the bead and skirt (which would be broken when the container is rotated).

The present invention is opened by rotating the lid until the pointer is aligned with a marker and then pushing up on the lid with the thumb. This child-resistance feature is in common use and is further described in U.S. Pat. No. 4,121,727 to Robbins et al. and U.S. Pat. No. 3,627,160 to Horvath. Neither of these closures however, possess the extensive features of the present invention. Additionally, these prior art closures may inadvertently be replaced with the pointer and marker aligned, thus rendering them "not" child-resistant. An object of the present invention is therefore, that the closure automatically shift into a child-resistant "out-of-alignment" orientation when closed, eliminating this problem. In other words, when the closure is closed, it cannot be immediately reopened without at least one additional step.

An object of the present invention is to provide a captive closure which aids user compliance. By using this invention, a user can readily monitor his/her own medication regimen, thus reducing medication errors, and also decreasing the involvement of health care professionals by providing a means for serf medication for users who might otherwise need assistance due to reduced mental and/or visual acuity or impaired physical strength or dexterity.

A further object and novel concept of the present invention is to provide a single lid structure for different dispensing frequencies. This novel structure is comprised of one or more marker sets enabling the user to monitor "at a glance" his/her next dose.

A further object is to provide a closure with extensive utility. The virtual hinge closure may be used for pet food, fertilizer, spices, cosmetics, gas caps, camera lens covers, nuts and bolts, candies, beads etc. The dynamic virtual hinge closure may also serve as a receptacle, rather than a dispenser, such as food storage or waste disposal containers.

A still further object and novel concept of this invention is to integrate ergonomic design with the user's own kinesthetic senses to facilitate dispensing by creating a routine that is automatic, foolproof, and familiar. With this ergonomic design a user is relieved from the necessity of reading often difficult to read instructions on the label each time he/she needs to make dispensing decisions.

This is accomplished by:

1) the clicks or stops prior to opening (to prevent skipping a dose;
2) the clicks after closing (to insure the lid is locked);
3) the position of the pointer relative to the marker(s);
4) the direction arrow on top surface; and
5) the raised or recessed indicia.

In combination, these features, by integrating the senses of touch (recessed markers, raised pointer), motion (stopping), sound (clicking), and sight (pointer and markers sets) result in a habitual dispensing routine by maximizing the users own kinesthetic senses. Additionally, there are advantageously no verbal indicia required, facilitating use by users who speak different languages, are illiterate, or blind.

Another object is that the virtual hinge closure may be stacked for use with spices as shown in FIGS. 13–15, or for use with multiple medicaments, having different frequencies as shown in FIGS. 16–17.

Another object of the present invention is to provide a single closure containing features required by both over-the-counter and prescription products, i.e.;

1) The closure may be assembled by forcing the lid onto the container straight down under pressure (i.e., the hook flexes over the bead due to its resiliency and/or the bead may be elliptical).
2) The container and lid surfaces meet such that a moisture resistant weld and tamper-evident film can be readily placed therein.
3) The lid and container touch on two contiguous surfaces, top and side, to enhance moisture/vapor retention.
4) The lid dynamically shifts into a locked position when closed.
5) Reliable operation —as the lid rotates, it can be opened once and only once at each marker.

A further object is to simplify tooling and facilitate molding by configuring the virtual hinge to minimize undercuts and/or camming actions.

Other objects, features and characteristics of the present invention, as well as the methods of operation and functions of the related elements of the structure, and the combination of pans and economies of manufacture, will become more apparent upon consideration of the following detailed description and the appended claims with reference to the accompanying drawings all of which form a part of this specification, wherein like reference numerals designate corresponding parts in the various Figures.

BRIEF DESCRIPTION OF DRAWINGS

The invention will further be described with reference to the following drawings, in which.

DETAILED DESCRIPTION OF THE PRESENTLY PREFERRED EXEMPLARY EMBODIMENTS

Several non-limiting embodiments of the virtual hinge are shown. The embodiments represented by FIGS. 1–4 and 5A–5B have a hook on the container and slot(s) in the lid. The embodiments represented by FIGS. 6–8C are reversed, having a hook on the lid and slot(s) on the container. Embodiments shown in FIGS. 1–4 and 6–8C are configured for non-monitored dispensing, while the embodiments shown in FIGS. 5A–5B and 9–11 are configured for monitored dispensing. The embodiments shown in FIGS. 13–17 are stacked and are used for dispensing spices and multiple medications.

While the different embodiments may have the same outward appearance, the embodiments with unique internal structure illustrated FIGS. 6–11, empower the user with reliable operation due to their built-in logic.

Figures 1, 2A, 2B, 3A, 3B, 3C, 4, 5A, 5B:
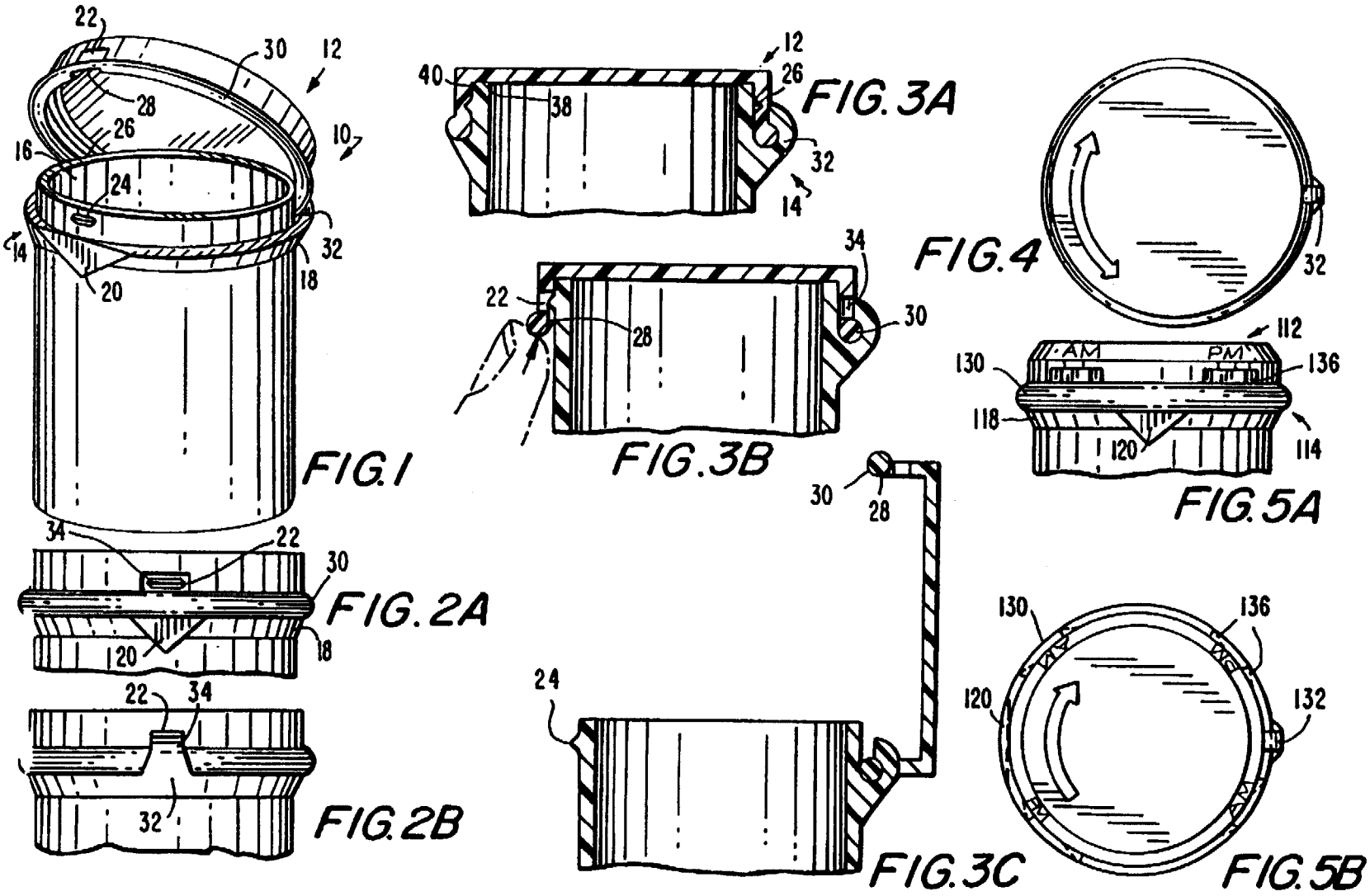
FIG. 1 shows a perspective view of the virtual hinge closure with hook on the container.
FIG. 2A shows a front view of the virtual hinge closure of FIG. 1 in the released position, after it has been aligned, just prior to being opened.
FIG. 2B shows a rear view of the closure of FIG. 2A.
FIG. 3A shows a cross-section of the closure of FIG. 1, when it is in the locked position.
FIG. 3B shows a cross-section of the closure of FIG. 2A, in the released position, and about to be opened with a user's thumb.
FIG. 3C shows a cross-section of the closure of FIG. 1, after it has been fully opened.
FIG. 4 shows a top view of the closure of FIG. 1.
FIG. 5A shows a front view of a closure similar to FIG. 1 in the locked position and configured for monitored dispensing having two sets of markers indicating AM and PM.
FIG. 5B shows a top view of the closure of FIG. 5A.

The embodiment of the virtual hinge in accordance with the present invention shown in FIG. 1 is designated generally by the reference character 10. The virtual hinge 10 includes a cylindrical lid 12 and a cylindrical container or container neck 14. The container includes a top port 16 and the lid 12 is shown unlocked and in the open position and spaced from the port 16. A skirt 18 on the container 14 contains a gap 20 within it. This gap 20, provides a space where the user can insert his thumb to push the lid up and also acts as a pointer 20, which when aligned with the marker 22, indicates that the lid is unlocked. The skin 18 also prevents the user from pushing up on the side of the lid. A locking lug 24 on the container 14 is rotatably held in a locking groove 26 in the lid 12 when the container is closed. To open, the user rotates the lid until the marker 22 and pointer 20 are aligned. The user then lifts the lid causing the locking lug 24 to move through the locking groove release 28. As the user lifts the lid, a hook 32 on the container dynamically engages with a slot 34 in the lid. The hook 32 is disposed diametrically opposite the locking lug 24, and aligns with the slot 34 when the pointer 20 is aligned with the marker 22. The slot(s) 34 in this embodiment also function as marker(s) 22 since the locking lug becomes visible through the slot 34 indicating to the user that the lid is in the unlocked or released position, and the interior of the slot 34, contains the locking groove release 28. The closure is shown in the locked position in FIG. 3A and the closure is shown in the unlocked or released position in FIGS. 1, 2A–B, 3B–C and 4. In FIG. 3C the lid is fully opened and the hook 32 is engaged in the slot 34 and surrounds the bead 30. The hook 32 and the looking lug 24 are located diametrically opposite each other. When the closure is closed as shown in FIGS. 3A–B the top rim 38 and side 40 of the container is in continuous contact with the inside of the lid, thus forming a seal on two contiguous surfaces, which enhances moisture/vapor retention and permits insertion of a tamper-evident film.

Another embodiment is shown in FIGS. 5A–B, and contains two marker sets each set indicating "AM" and "PM". Like reference numerals in the 100 series are used in this and future embodiments to designate like components. The markers AM, PM could be raised, recessed, or flat and are slanted so that they may be easily molded from the top without requiring camming actions. A marker set may be positioned on an arc portion of the lid which is less than 180 degrees so that the user can easily see or feel the entire marker set without rotating the container. The lid is locked by the hook 132 surrounding the bead 130 and by the locking lug 124 in locking groove 126. The slots/markers 134/122, indicating "AM" and "PM" are diametrically opposite each other. Ratchets 136 are on either side of each of the 4 slots/markers. These ratchets signal to the user that the lid has been locked or unlocked and also permit the lid to rotate in only one direction. The hook 132, snaps past these ratchets 136 as the lid is rotated from a locked to an unlocked position. The locking groove releases 128 are on the interior of the lid 112, directly behind each slot/marker 134/122 combination. The user lifts up the lid by pushing his/her thumb under the lid in the gap 120 after the pointer 120 and marker 122 are aligned as shown in FIG. 3B. This upward movement on the lid causes the locking lug 124 to move through the locking groove release 128 and the hook 132 to dynamically engage with the slot 134. A portion of the bead 130 below the slot 134, may have a modified cross-section (e.g., the undercut created by the cross-section of the bead can be eliminated).

Figures 6, 6A, 7A, 7B, 7C, 7D, 8A, 8B, 8C:
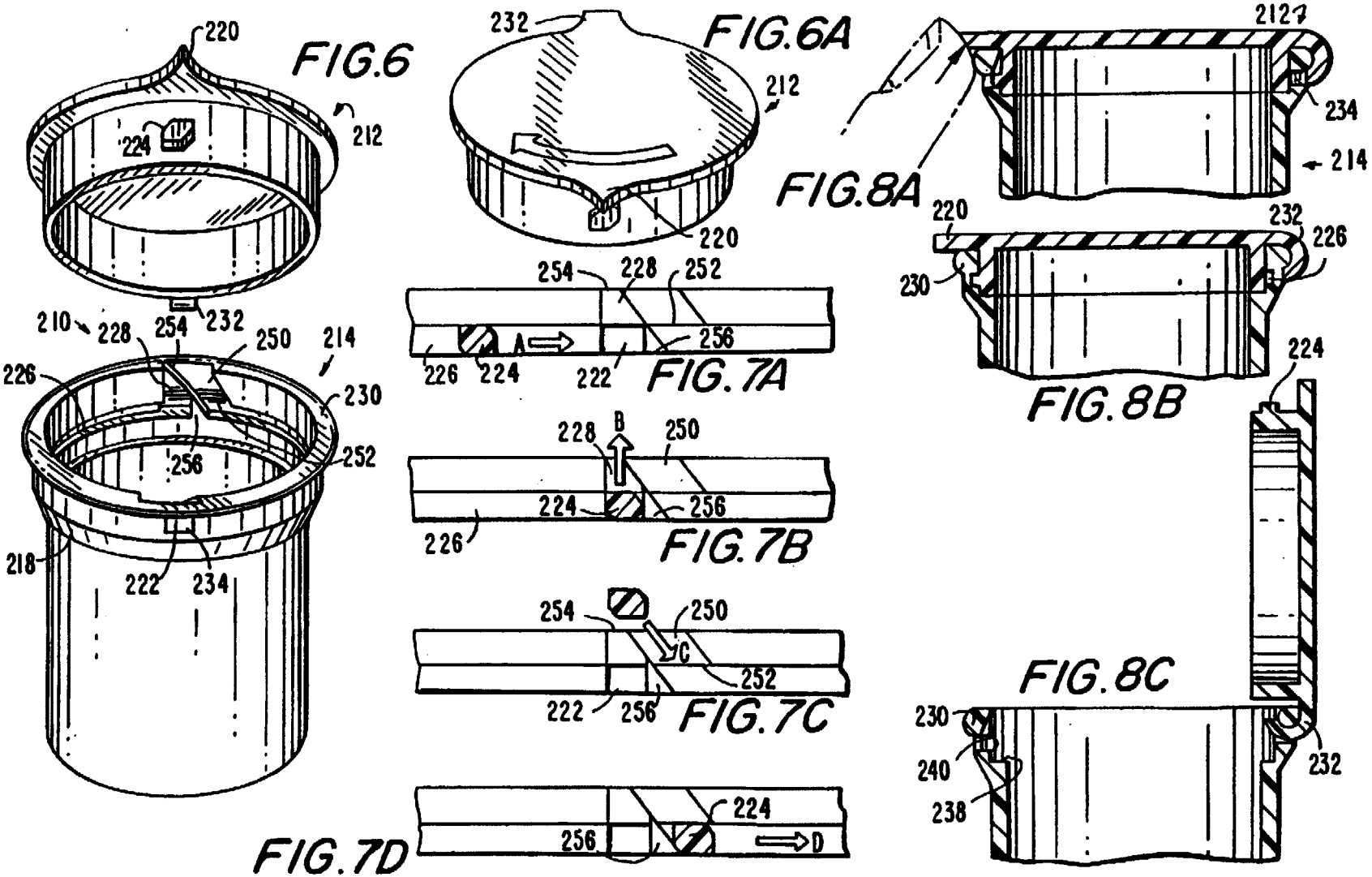
FIG. 6 shows a perspective view of the virtual hinge closure with the hook on the lid and the repeated dynamic shifting feature in the container neck.
FIG. 6A shows a perspective view of the top view of the lid of FIG. 6.
FIG. 7A is an expanded view of the inside of the bead showing the dynamic shifting feature and the locking lug positioned in the locking groove.
FIG. 7B shows the locking lug in the released position, ready for the lid to be opened.
FIG. 7C shows the locking lug above the container rim after the lid has been opened.
FIG. 7D shows the inside of the bead, after the lid has closed (i.e., the locking lug has dynamically shifted back into the locking groove)
FIG. 8A shows a cross-section of the closure of FIG. 6 in the released or unlocked position and about to be opened with the thumb.
FIG. 8B shows a cross-section of the locked closure of FIG. 6.
FIG. 8C shows a cross-section of the closure of FIG. 8A in the opened position.

The embodiment shown in FIGS. 6–8C has the hook 232 on the lid 212 and the slot 234 on the container 214. A marker 222 on the container 214 aligns with a pointer 220 on the lid to signal that the lid is in the unlocked position as shown in FIGS. 6, 8A and 8C. FIGS. 7A–7D show an exploded view of the inside of the container neck 214 and show the sequence of movements which occur when the user opens and closes the lid. FIG. 7A shows the locking lug 224 moving into alignment with the slot 222 in the direction of arrow A. FIG. 7B shows the locking lug 224 snapping out of the locking groove release ramp 228, in the direction of arrow B, as the lid is opened. FIG. 7C shows the lid being closed and the locking lug 224 dynamically shifting as it is guided along the curved edge surface 254 of the locking groove release ramp 228, in the direction of arrow C, and through the shifting ramp 250, toward the locking groove 226. FIG. 7D shows the locking lug 224, after it has snapped past the stepped ridge 252 and is in the locking groove 226, where it can then be rotated, in the direction of arrow D, to the next marker position. The ridge 252 at the end of the shifting ramp 250 snaps the locking lug 224 into the locking groove 226 and also prevents the locking lug 224 (or lid) from reversing back into the shifting ramp 250. The locking lug 224, could alternatively be prevented from reversing, by a narrowing of the two sides of the shifting ramp 250. The detente 256 guides the locking lug 224 into the locking groove 226 and also prevents the locking lug 224 (or lid) from moving backwards to the prior marker position. The lid and container form a seal on two contiguous surfaces, the bottom of the lid 238 and the side 240. The dynamic shift which occurs when the user closes the lid serves three important functions.

1) The lid, when closed is always left in a child-resistant position.
2) The detente prevents the user from reopening the lid at the previous marker position.
3) The detente also insures that the lid must be opened at each marker position.

The lid of this embodiment is designed to be held and turned by the thumb and middle finger, in front of the pointer 220 and the hook 232, respectively. This lid could of course, have been configured for monitored dispensing in which case the indicia could advantageously (for molding) be placed on the slanted skirt 218.

The embodiment shown is FIGS. 9–11C has two sets of three markers 322 indicating a 1st, 2nd, and 3rd dose. Since a bead 330 surrounds the entire container, the lid 312 may be forced down in any orientation for assembly. In this embodiment, locking groove 326 and the locking groove release ramp 328 are disposed on the lid, and the hook 332 and locking lug 324 are disposed on the container neck 314. The virtual hinge container neck 314 as shown here is separate from the container 360 and adapted to fit over its top. The container neck 314 could be force fit over the container top or threaded onto the top of the container 360, etc. The sequence of movements which occur when the user opens and closes the lid are similar to the sequence of movements discussed with respect to FIGS. 7A–7D. It should be noted that, referring to FIG. 9, the interior configuration of the lid which engages the locking lug 324 is hidden from view in FIG. 9, but has the same structure as the portion of the interior of the lid which is visible:

1) the locking lug 324 moves into alignment with the slot 322;
2) the locking lug 324 snaps out of the locking groove release ramp 328 as the lid is opened;
3) as the lid is closed, the locking lug 324 dynamically shifts, as it is guided along the curved edge surface 354 of the locking groove release ramp 328, and through the shifting ramp 350; and
4) the locking lug 324 snaps past the stepped ridge 352 and is positioned in the locking groove 326.

Figures 9, 10A, 10B, 11A, 11B, 11C, 12:
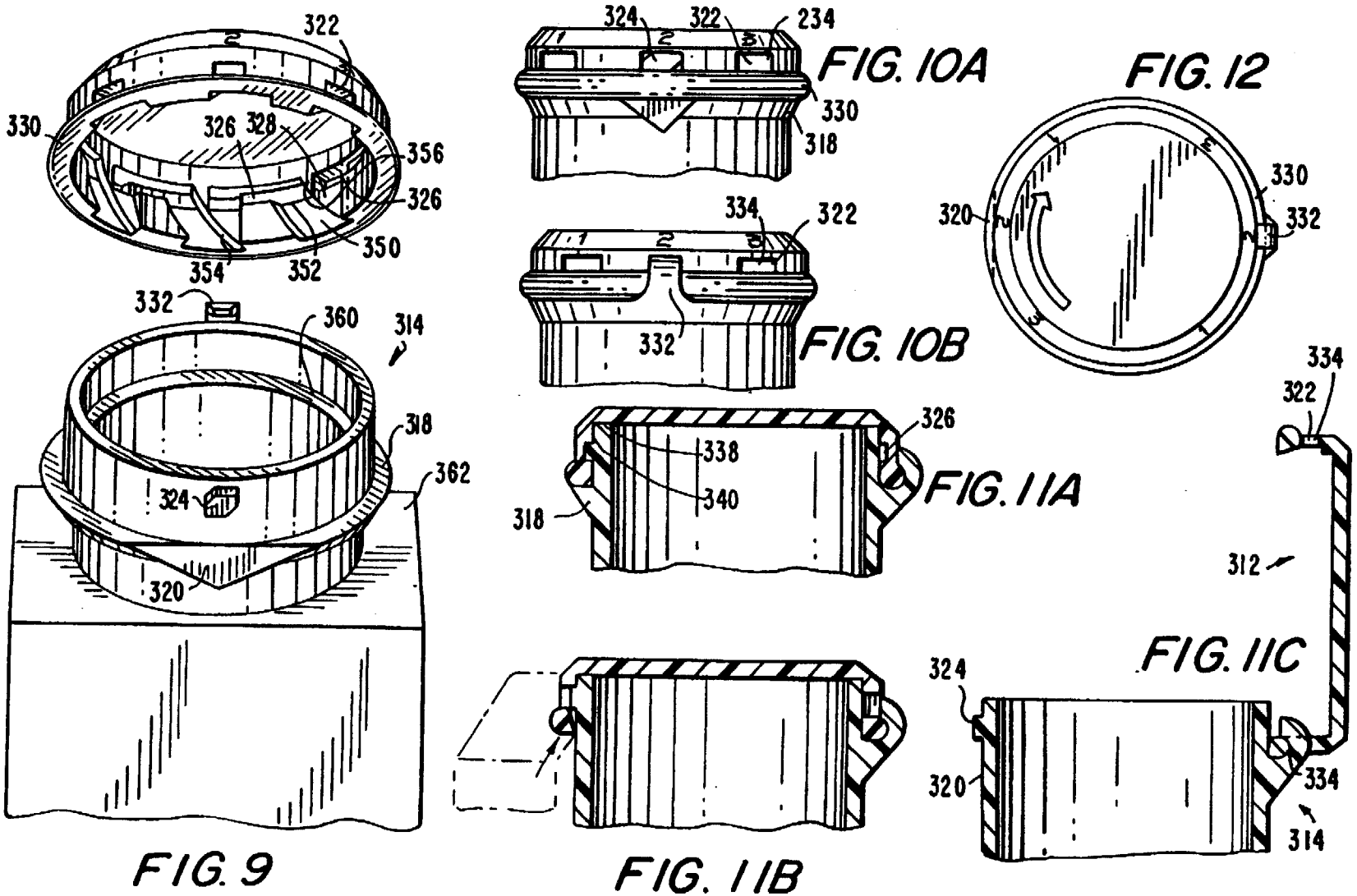
FIG. 9 shows a perspective view of the virtual hinge closure adapted to fit over the neck of a container, with hook on the container and two sets of three markers on the lid.
FIG. 10A shows the front view of the virtual hinge closure of FIG. 9 aligned and ready to be opened in the released position.
FIG. 10B shows the rear view of the closure of FIG. 10A.
FIG. 11A shows a cross-section of the locked closure of FIG. 9.
FIG. 11B shows a cross-section of the unlocked or released closure of FIG. 9, about to be opened using a counter top.
FIG. 11C shows a side view of the closure of FIG. 11B after it has been opened.
FIG. 12 shows a top view of the unlocked or released closure of FIG. 9.

After this sequence of movements, the lid cannot back into the shifting ramp 350, due to the stepped ridge 352; and the lid is prevented from returning to the prior marker position due to the detente 356. FIG. 11B shows this closure being opened using, for example, a counter top to provide additional leverage.

Figure 13:
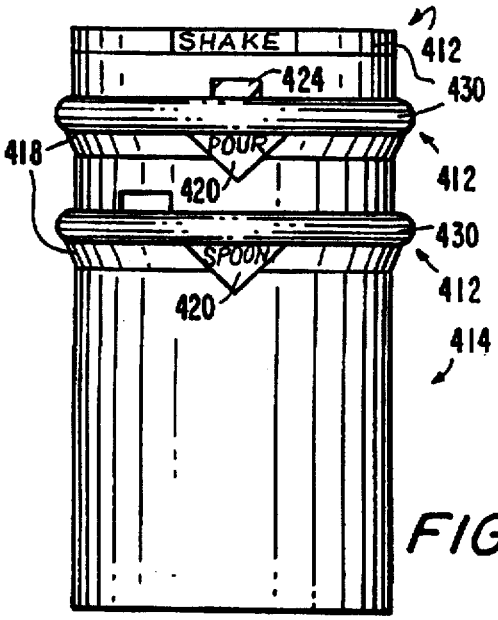
FIG. 13 shows a from view of a stacked virtual hinge closure used for dispensing spices.
Figure 14A:
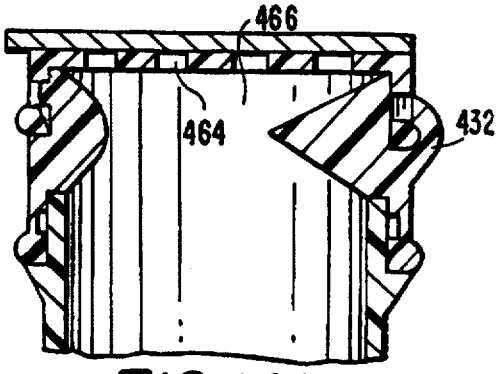
FIG. 14A shows a cross-section of the closure of FIG. 13.
Figure 15:
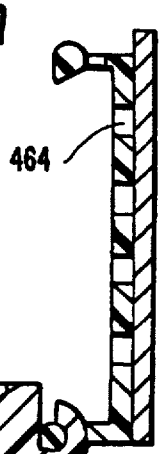
FIG. 15 shows the partial interior view of the bead including the locking groove release ramp and the dynamic shifting ramp for the "pour" or "spoon" lid of FIG. 13.
Figure 15:
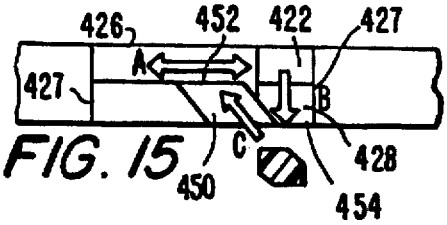
Figure 14B:
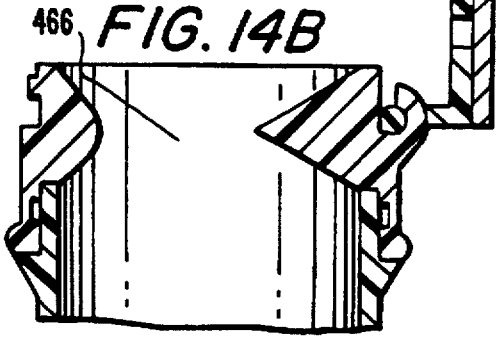
FIG. 14B shows a cross-section of the closure of FIG. 13 after it has been opened in the "pour" position.

FIGS. 13–15 show a stacked embodiment of the virtual Hinge closure used for dispensing spices. The lid indicating "shake" includes a living hinge which, when opened, exposes holes for shaking the spices out. The lid indicating "pour" has a spout shaped interior 464, so that the contents pour out. The lid indicating "spoon" exposes the entire contents of the interior so that a spoon can fit in.

FIG. 15 shows the back and forth movement of the locking lug 424 in relation to the locking groove release ramp 428 and the shifting ramp 450 when the user opens and closes the lid of FIG. 13.

1) The locking lug 424 moves in the locking groove 426 to the right along arrow A, into the released position so that the lid may be opened.
2) The locking lug 424 next moves through the locking groove release ramp 428, in the direction of arrow B, as the lid is opened.
3) The locking lug 424, moves through the shifting ramp 450, in the direction of arrow C, into the locking groove 426, as the lid is closed and locked.

The locking groove 426 stops at 427, and so the lid must reverse, and the above sequence is repeated at the same marker position the next time the container is opened and closed. This results in this lid alternating back and forth between a locked and unlocked position.

Figure 16:
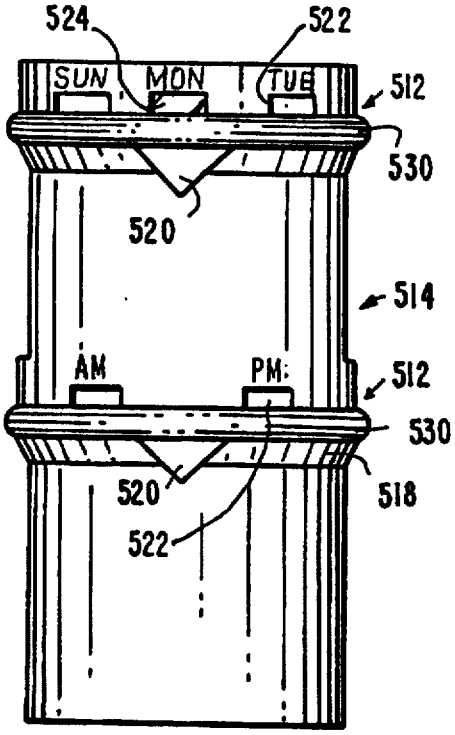
FIG. 16 shows a front view of a stacked virtual hinge closure having two separate compartments.
Figure 17:
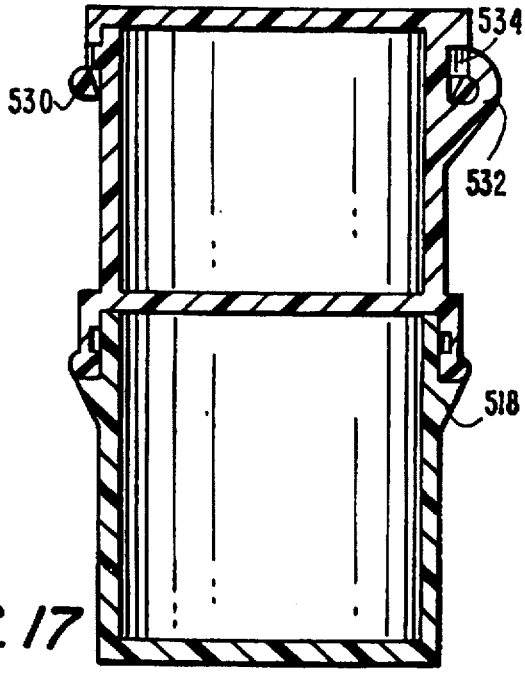
FIG. 17 shows a cross-section of the closure of FIG. 16.

FIGS. 16–17 shows the stacked virtual hinge closure having separate compartments, for monitored dispensing of different medications having different frequencies. The use of one lid does not affect the other. Any combination or number of lid embodiments could of course be used for stacking.

The closure has been described as being in an open and closed position and as being in an unlocked and locked position. The closure is in the open position when the lid is spaced from 10 the container and the hook is engaged with a slot. The closure is in the unlocked position when the pointer is aligned with a marker and the hook is positioned to enter the slot. The closure is in the locked position when the pointer and marker are out of alignment, and the lid is held down on both sides.

1) The lid is held down on one side by a hook surrounding the bead.
2) The lid is held down on the opposite side by the locking lug held in the locking groove.

Although this invention has been described generally and in terms of presently preferred exemplary embodiments, these should not be construed as limiting the scope of the invention. For example, the hook might have a different shape and still perform the same function of holding the lid to the container in a fixed position relative to the pointer. The marker(s) and/or pointer may have different shapes, be flat (rather than raised or recessed), and/or have no numerical indicia (i.e., roman numerals or pictures, etc.).

The ratchets on either side of the slots may be modified or positioned in the locking groove. The bead may surround the entire closure or a portion of the closure. The hook and slot may be any members which dynamically engage and disengage as the closure opens and closes. The closure may be made of material other than plastic. Thus, the scope of this invention should be determined by the appended claims and their legal equivalents, rather than the examples given.

While the invention has been described in connection with what is presently considered to be the most practical and preferred embodiments, it is to be understood that the invention is not limited to the disclosed embodiments, but on the contrary, is intended to cover various modifications and equivalent arrangements included within the spirit and scope of the appended claims.

What is claimed is:

1. A virtually hinged closure, comprising:

(a) a substantially cylindrical lid;

(b) a substantially cylindrical neck member, said lid being movable between a closed and an opened position, said closed position including a locked position and a released position, wherein in said locked position said lid is immovable to said opened position and in said released position said lid is movable to said opened position, said lid being rotatably fixed relative to said neck member in said open position only;

(c) at least one marker position being associated with one of said lid and said neck member;

(d) pointer means for indicating said at least one marker position, said pointer means being associated with the other one of said lid and said neck member;

(e) locking means for rotatably locking said lid to said neck member in said closed position;

(f) selective release means for allowing selective release of said locking means;

(g) a shifting ramp disposed on one of said lid and said neck member for shifting said lid from said released position to said locked position during movement of said lid from said opened position to said closed position; and (h) dynamic selective engagement means which dynamically cooperates with said selective release means for selectively engaging said lid to said neck member during movement of said lid from said closed to said opened position, said dynamic selective engagement means selectively fixing one of said at least one marker position with respect to said pointer means.

2. A virtually hinged closure according to claim 1, further including an indicating means for indicating to the user when the lid has been rotated from said locked position to said released position.

3. A virtually hinged closure according to claim 1, wherein said dynamic selective engagement means is disposed on an outer surface of said virtual hinge closure.

4. A virtually hinged closure according to claim 1, wherein said lid has at least two contiguous surfaces that are in contact with at least with two contiguous surfaces of said neck member.

5. A virtually hinged closure according to claim 1, further including a means for preventing said lid from reversing direction after said lid has moved from said opened position to said closed position.

6. A virtually hinged closure according to claim 1. wherein said shifting ramp prevents said lid from opening after said lid has moved from said opened to said closed position, said shifting ramp includes a stepped ridge.

7. A virtually hinged closure according to claim 1, further including a means for preventing continuous rotation of said lid with respect to said neck member.

8. A virtually hinged closure according to claim 7, wherein said means for preventing continuous rotation includes a detente.

9. A virtually hinged closure according to claim 1, wherein said locking means includes a hook on one of said lid and said neck member and a bead on the other one of said lid and said neck member, said hook engages with said bead to rotatably lock said lid to said neck member in said closed position.

10. A virtually hinged closure according to claim 9, wherein said dynamic selective engagement means includes said hook and said bead, said hook selectively engaging with a slot adjacent to said bead and pivoting about said bead during movement of said lid from said closed to said opened position.

11. A virtually hinged closure according to claim 9, wherein said hook is disposed on said lid and said bead is disposed on said neck member.

12. A virtually hinged closure according to claim 9, wherein said bead is disposed on said lid and said hook is disposed on said neck member.

13. A virtually hinged closure according to claim 1, wherein said locking means includes a locking lug on one of said lid and said neck member, said locking lug rotates within a locking groove on the other one of said lid and said neck member.

14. A virtually hinged closure according to claim 13, wherein said selective release means includes a locking groove release, which enables release of said locking lug from said locking groove when said lid is moved from said closed position to said opened position.

15. A virtually hinged closure according to claim 13, wherein said locking lug is disposed on said lid and said locking groove is disposed in said neck member.

16. A virtually hinged closure according to claim 13, wherein said locking groove is disposed in said lid and said locking lug is disposed on said neck member.

17. A virtually hinged closure, comprising:

(a) a substantially cylindrical lid;

(b) a substantially cylindrical neck member, said lid being movable between a closed and an opened position, said closed position including a locked position and a released position, wherein in said locked position said lid is immovable to said opened position and in said released position said lid is movable to said opened position, wherein in said open position only, said lid is rotatably fixed relative to said neck member;

(c) a first locking means for rotatably locking said lid to said neck member in said closed position;

(d) a second locking means cooperating with said first locking means to lock said lid to said neck member in said closed position;

(e) a first selective release means for allowing selective release of said first locking means from said closed to said opened position and dynamically engaging said lid to said neck member in said opened position;

(f) a second selective release means cooperating with said first selective release means for allowing selective release of said second locking means; and (g) a shifting ramp disposed on one of said lid and said neck member which shifts said lid from said released position to said locked position when said lid is moved from said opened position to said closed position.

18. A virtually hinged closure according to claim 17, further including indicating means for indicating to the user that the lid had been rotated from said locked position to said released position.

19. A virtually hinged closure according to claim 17, wherein said lid has at least two contiguous surfaces that are in contact with at least two contiguous surfaces of said neck member.

20. A virtually hinged closure according to claim 17, further including at least one additional lid being attached to said virtual hinge closure.

21. A virtually hinged closure according to claim 17, wherein said first selective release means and said second selective release means are disposed at substantially the same angular position on one of said lid and said neck member.

22. A virtually hinged closure according to claim 17, further including a means for preventing said lid from reversing direction after said lid has moved from said opened position to said closed position.

23. A virtually hinged closure according to claim 17, wherein said shifting ramp prevents said lid from opening after said lid has moved from said opened to said closed position, said shifting ramp, includes a stepped ridge.

24. A virtually hinged closure according to claim 17, further including a means for preventing continous rotation of said lid with respect to said neck member.

25. A virtually hinged closure according to claim 24, wherein said means for preventing continuous rotation includes a detente.

26. A virtually hinged closure according to claim 17, wherein said first locking means includes a hook on one of said lid and said neck member and a bead on the other one of said lid and said neck member, said hook engages with said bead to rotatably lock said lid to said neck member in said closed position.

27. A virtually hinged closure according to claim 26, wherein said first selective release means includes said hook and said bead, said hook dynamically engages with a slot disposed adjacent to said bead and pivoting about said bead during selective release of said first locking means from said closed position to said opened position.

28. A virtually hinged closure according to claim 26, wherein said hook is disposed on said lid and said bead is disposed on said neck member.

29. A virtually hinged closure according to claim 26, wherein said bead is disposed on said lid and said hook is disposed on said neck member.

30. A virtually hinged closure according to claim 17, wherein said second locking means includes a locking lug disposed on one of said lid and said neck member, said locking lug rotates within a locking groove on the other one of said lid and said neck member.

31. A virtually hinged closure according to claim 30, wherein said second selective release means includes a locking groove release for release of said locking lug from said locking groove when said lid is moved from said closed position to said opened position.

32. A virtually hinged closure according to claim 30, wherein said locking lug is disposed on said lid and said locking groove is disposed in said neck member.

33. A virtually hinged closure according to claim 30, wherein said locking groove is disposed in said lid and said locking lug is disposed on said neck member.

34. A closure comprising:

a shifting ramp disposed on one of a lid and a neck member for automatically shifting an angular position of said lid relative to said neck member during substantial axial movement of said lid from an opened position to a closed position; and (b) a stepped ridge disposed in said shifting ramp, said stepped ridge locks said lid to said neck member when said lid is moved from said opened position to said closed position.

* * * * *